US006581214B1

(12) United States Patent
Love et al.

(10) Patent No.: US 6,581,214 B1
(45) Date of Patent: Jun. 24, 2003

(54) SPACER AND SHIM ASSEMBLY AND PROCESS OF ELEVATING THE WATER CLOSET RING OF A TOILET BOWL

(76) Inventors: Joe A. Love, 848 Helen Dr., Hollister, CA (US) 95023; Herman T. Charity, III, P.O. Box 968, San Jose, CA (US) 95108; Lincoln J. Alvord, 225 Encina Ave., Redwood City, CA (US) 94061

( * ) Notice: Subject to any disclaimer, the term of this patent is extended or adjusted under 35 U.S.C. 154(b) by 0 days.

(21) Appl. No.: 10/146,230

(22) Filed: May 14, 2002

(51) Int. Cl.[7] ..... E03D 11/00

(52) U.S. Cl. ..... 4/252.2; 4/252.1; 4/252.3; 4/252.4; 285/56; 285/59; 285/60

(58) Field of Search ..... 4/252.1, 252.2, 4/252.3, 252.4; 285/56, 59, 60

(56) References Cited

U.S. PATENT DOCUMENTS 571,471 A * 11/1896 Davis ..... 4/252.5
4,384,910 A * 5/1983 Prodyma ..... 156/92
4,515,398 A * 5/1985 Machon, Sr. ..... 285/59
5,018,224 A * 5/1991 Hodges ..... 4/252.6
5,291,619 A * 3/1994 Adorjan ..... 4/252.6
5,303,430 A * 4/1994 Fernie et al. ..... 4/254
6,209,572 B1 * 4/2001 Wicklund ..... 137/315.01

* cited by examiner

*Primary Examiner*—Gregory Huson
*Assistant Examiner*—Azy Kokabi
(74) *Attorney, Agent, or Firm*—The Kline Law Firm

(57) ABSTRACT

A system utilizing multiple spacer and shim elements that nest together to raise a closet ring to the height required for the particular floor being used in a given application for a toilet bowl installation. The nested spacer and shim elements are placed on the rough floor and receive the closet ring mounting flange. Bosses on an upper side of a lower spacer and shim element are received in detents in a lower side of a corresponding upper spacer and shim element so that the spacer and shim elements are held securely in their nested position so as to form a registered spacer/shim stack. The spacer and shim elements will typically be ¼" thick. The spacer and shim elements further include breakaway mounting tabs positioned about an outer circumference of the main body of the spacer and shim elements. The mounting tabs, in conjunction with mounting adapter slots in the main body of the spacer and shim elements, provide the flexibility for the spacer and shim elements to be used with any of the various toilet bowl base shapes in use in the industry.

7 Claims, 9 Drawing Sheets

SPACER AND SHIM ASSEMBLY AND PROCESS OF ELEVATING THE WATER CLOSET RING OF A TOILET BOWL

BACKGROUND OF THE INVENTION

1. Field of the Invention

The present invention relates generally to plumbing fittings, and more particularly is a spacer and shim assembly and process for elevating the water closet ring of a toilet bowl.

2. Description of the Prior Art

In the construction of new and renovated residential and commercial-buildings, the regulatory agencies of the locale in which the construction is taking place will place specific requirements on the construction. These requirements are regulated through the drawing approval, permit issuing, and inspection processes. Before any actual construction can begin on any job, all material must be ordered, and the various subcontracting trades must be scheduled so that each particular phase of the project contracted for by the subcontractors can be timely completed. In short, most aspects of any specific construction job are planned well in advance.

Today there are several problems associated with the installation of a closet ring of a toilet bowl in new and renovated building construction. The toilet bowl installation requires that the closet ring be installed at the finished floor level so that the wax seal is properly seated in the cavity of the toilet bowl base when the toilet bowl is installed in order to provide a proper seal against the waste water and sewer gases. This installation requirement is also a UPC (uniform plumbing code) requirement. Most plumbing tradesmen rely upon the carpentry trade to provide some type of floor buildup (typically a wooden spacing element) at the waste soil pipe location. The plumber later installs the closet ring.

This arrangement can be unsatisfactory in that the carpenter does not always provide a good fit for the waste soil pipe, and the necessity of coordinating between the two trades leads to significant added expense. Having the carpenter provide for the plumbing fixture can lead to at least two problems: (1) Because the subfloor or rough floor is usually made of plywood, when the cut for the closet ring flange is made, the plywood immediately adjacent the cut is weakened, sometimes visibly. The wood glue binding the plywood can fail so that the compressed material of the plywood separates. The integrity of the closet ring flange installation is therefore tremendously compromised. (2) A less than perfect fit for the closet ring flange installation will degrade with time and use. Any movement of the toilet bowl can overcome the seal, and result in corrosive waste water leakage. This corrosive waste water will quickly cause the toilet bowl mounting bolts to fail.

One example in the prior art is the "Stackable Soil Pipe Spacer Flange" of Hodges, U.S. Pat. No. 5,018,224, issued May 28, 1991. The Hodges device attempts to meet the requirements of the UPC code language that states that a closet ring must be installed to finished floor height. The ring shaped spacers are stacked on top of an installed closet ring flange top surface in a quantity sufficient to bring the stack to finished floor height. Adding spacers on top of an installed closet ring flange is contrary to applicable building codes, and does not provide a suitably stable base for the toilet bowl.

A device that adopts a similar approach, and unfortunately embodies the same shortcomings as the Hodges device, is the "Method of Extending a Soil Pipe Flange" of Prodyma, U.S. Pat. No. 4,384,910, issued May 24, 1983.

Accordingly, it is an object of the present invention to provide a spacer and shim device that raises a closet ring flange to a desired height to accommodate any type of flooring in a given installation.

It is a further object of the present invention to provide a base with maximum stability upon which to mount the toilet.

SUMMARY OF THE INVENTION

The present invention is a system utilizing multiple spacer and shim elements of uniform thickness. The spacer and shim elements nest together so as to raise the closet ring to the height required for the particular floor being used in a given application. The nested spacer and shim elements are placed on the rough floor and receive the closet ring mounting flange. Hemispherical bosses on an upper side of a lower spacer and shim element are received in detents in a lower side of a corresponding upper spacer and shim element so that the spacer and shim elements are held securely in their nested position so as to form a registered spacer/shim stack. The spacer and shim elements will typically be ¼" thick.

The spacer and shim elements each include a central aperture designed to fit all commonly used closet ring flanges. The spacer and shim elements further include breakaway mounting tabs positioned about an outer circumference of the main body of the spacer and shim elements. The mounting tabs in conjunction with mounting adapter slots in the main body of the spacer and shim elements provide the flexibility for the spacer and shim elements to be used with any of the various toilet bowl base shapes in use in the industry.

An advantage of the present invention is that it is mounted underneath the closet ring of the toilet being installed, thereby providing a more stable base for the toilet than can be obtained with spacers and shims added above the closet ring.

Another advantage of the present invention is that the breakaway mounting tabs and the mounting adapter slots allow the spacer and shim element of the present is invention to be used with any model of toilet.

A still further advantage of the present invention is that the spacer and shim elements have locking elements to provide a secure, nested, registered conformation when the spacer and shim elements are stacked.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

The present invention is a spacer and shim assembly 10 that is adapted to be used when installing toilet fixtures in a bathroom. The spacer and shim assembly is used to accommodate varying installed floor thicknesses, so that no matter how thick the finished floor might be, the water closet ring of the toilet bowl can always be mounted so that it is flush with the top surface of the finished floor.

Figure 1:
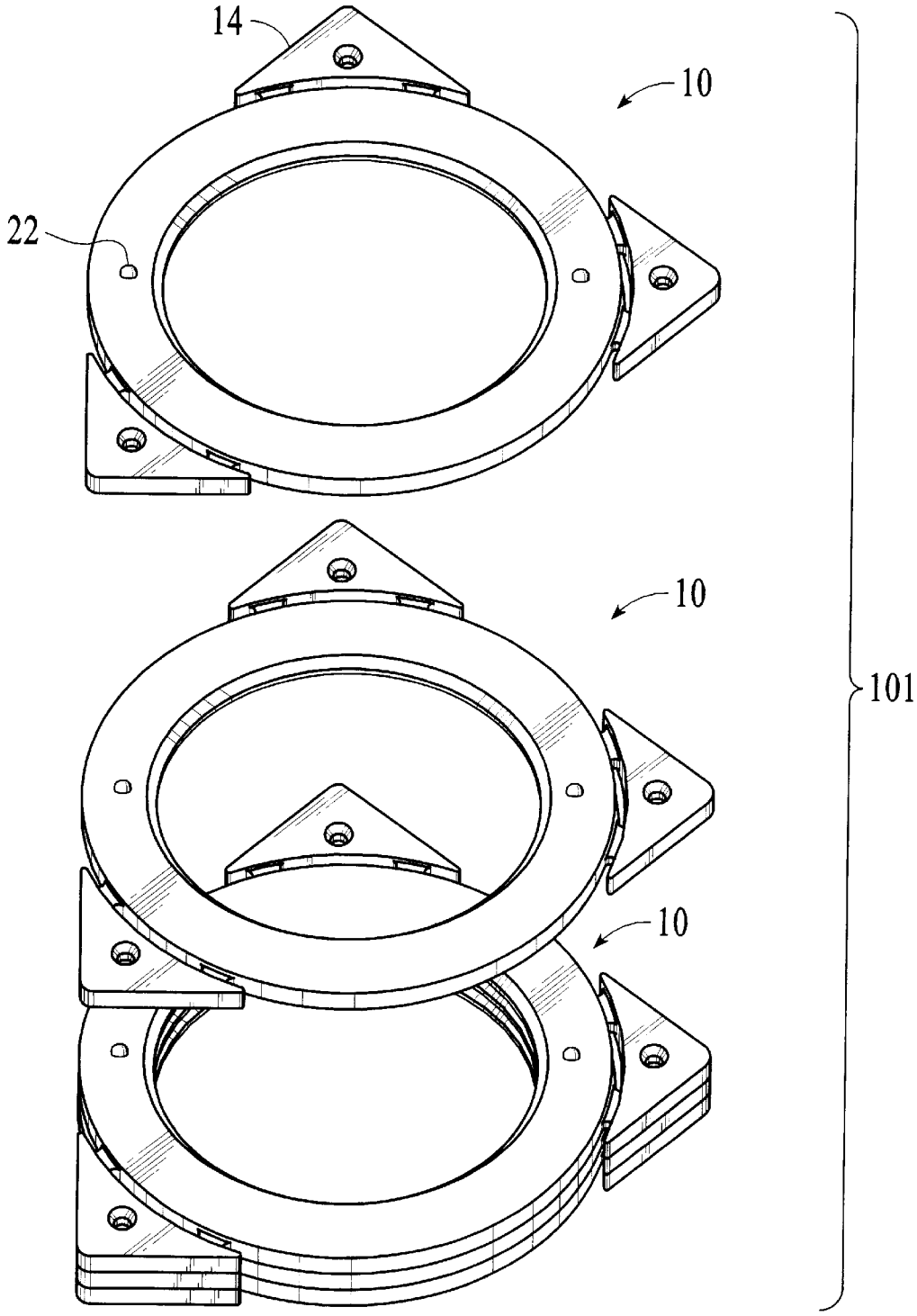
FIG. 1 is a perspective view of a plurality of the spacer and shim assemblies of the present invention in a nested conformation.
Figure 2:
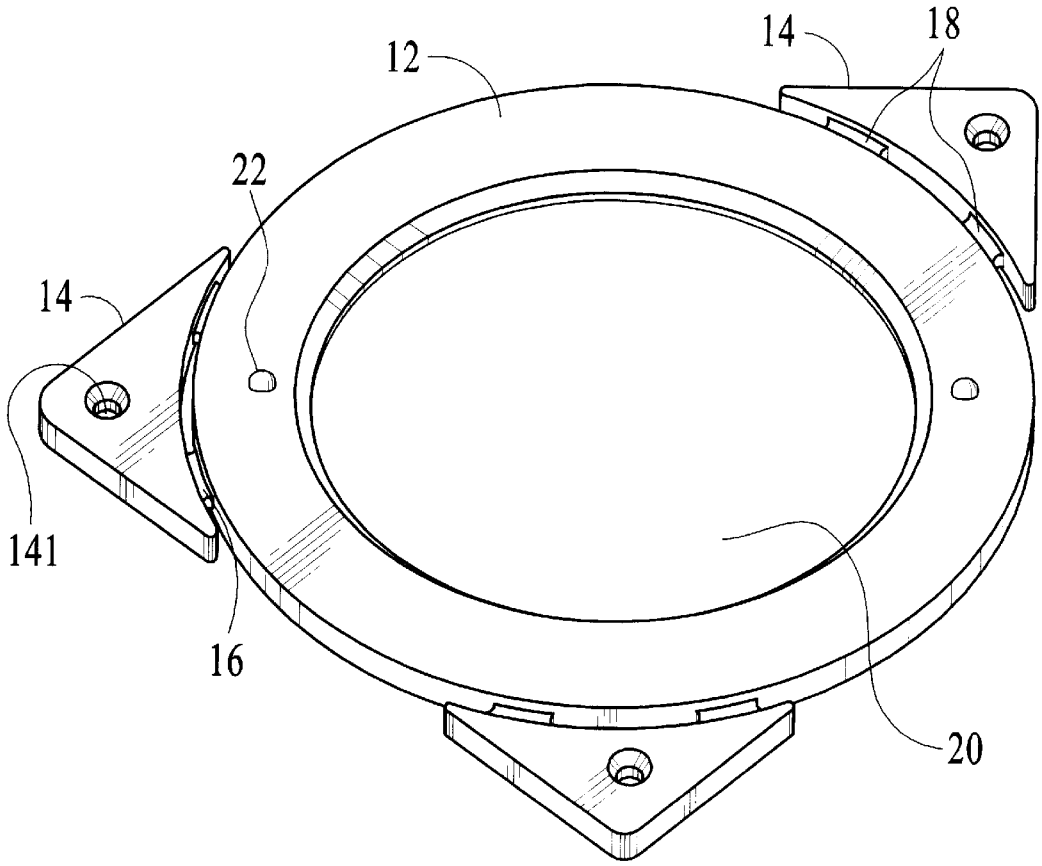
FIG. 2 is a top side perspective view of the spacer and shim assembly.
Figure 3:
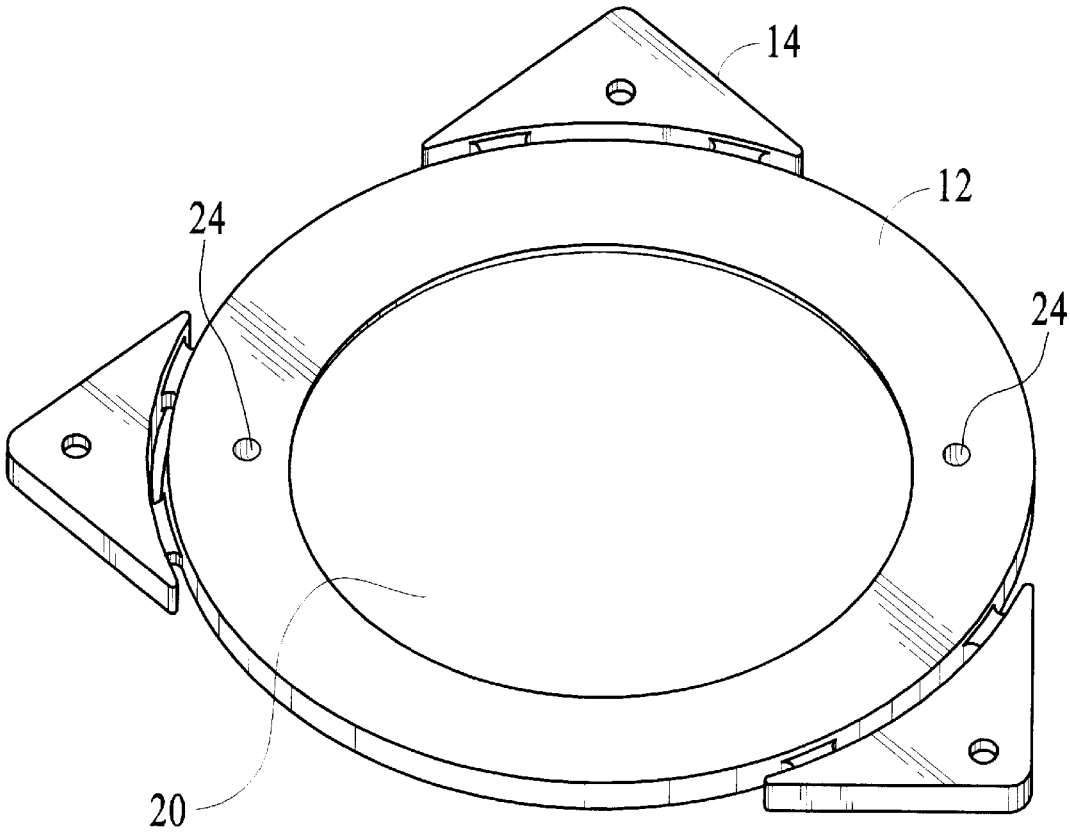
FIG. 3 is a bottom side perspective view of the spacer and shim assembly.

Referring first to FIGS. 1–3, the spacer and shim assembly 10 comprises an annular main body 12. A plurality of mounting tabs 14 are positioned about the circumference of the annular main body 12. The mounting tabs 14 provide a convenient means of firmly attaching the spacer and shim assembly 10 to a floor. The mounting tabs 14 each include a screw hole 141 to receive a fastening screw to affix the spacer and shim assembly 10 to the rough floor. When the closet ring flange is mounted on the spacer and shim assembly 10, the mounting screws are power driven through the mounting screw holes of the closet flange, and through the main body 12 of the spacer and shim assembly 10. The structural support and mounting means provided by the dip spacer and shim assembly 10 guarantees that the closet ring flange assembly is firmly secured to the construction subfloor structure regardless of the irregular nature of the hole cut size of the soil pipe and pipe access. The structural support is further enhanced by the extension of the mounting tabs 14 to firmer and stronger portions of the wood rough floor.

The mounting tabs 14 are separated from the annular main body 12 by a grooved area 16 so that the mounting tabs 14 may be easily removed from the main body 12 of the spacer and shim assembly 10. The grooved area 16 will typically be at least in part completely open, so that only discrete attaching segments 18 join the mounting tabs 14 to the annular main body 12. Removal of one or more of the mounting tabs 14 becomes necessary for a particular installation if, for example, a tab 14 is coincidental to the base mounting elements of the toilet bowl to be installed. In the preferred embodiment, three mounting tabs 14 are utilized.

The annular main body 12 further comprises a central aperture 20 that receives the water closet ring mounting flange. To aid in the installation of the water closet ring mounting flange, the central aperture 20 has a bevelled edge. The bevelled throat of the spacer and shim assembly 10 is designed to receive the cone-shaped throat of the closet ring flange when the spacer and shim assembly 10 is installed bevel up.

A key feature of the spacer and shim assembly 10 of the present invention is its nesting capability. The spacer and shim assembly 10 includes at least two protruding hemispherical bosses 22 protruding from an upper surface of a first spacer and shim assembly 10. The bosses 22 are received in corresponding detents 24 in a lower surface of a second spacer and shim assembly 10 stacked on top of the first spacer and shim assembly 10 to form a registered, mated stack 101 (see FIGS. 1 and 8). The mating of the bosses 22 with the detents 24 prohibits the stacked spacer and shim assemblies 10 from sliding and/or rotating relative to each other, regardless of how many spacer and shim assemblies 10 are placed together in the stack 101.

The spacer and shim assembly 10 is formed from an acrylonitrile butadiene styrene (ABS) plastic material. Because ABS is also used to form the water closet ring mounting flange, the spacer and shim assembly 10 bonds easily and effectively to each other and to the mounting flange. Other commercially available spacing devices use polypropylene, which therefore requires a bonding of unlike materials to be secured to the mounting flange. Moreover, polypropylene is significantly more compressible than is ABS. Therefore utilizing ABS for the spacer and shim assembly 10 yields a more stable mounting area for the soil pipe mounting flange. The spacer-and shim 10 will typically be constructed with a thickness of ¼".

FIRST ALTERNATE EMBODIMENT

Figure 4:
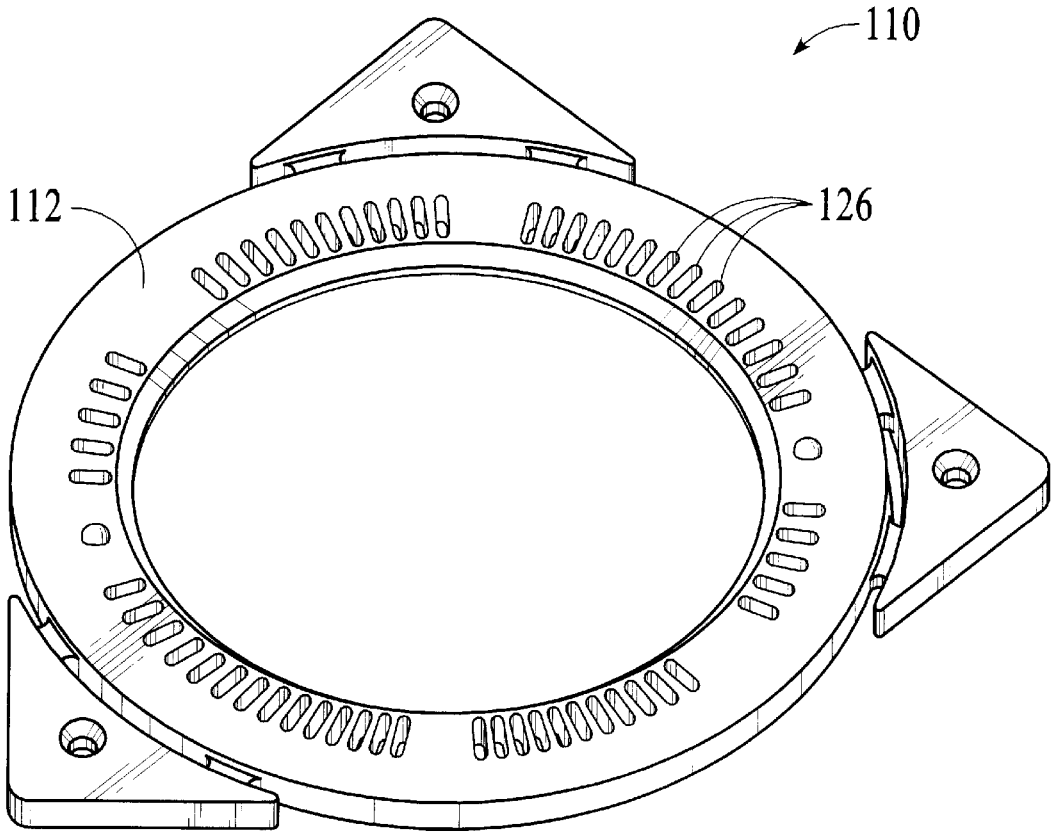
FIG. 4 is a top side perspective view of a second embodiment of the spacer and shim assembly.
Figure 5:
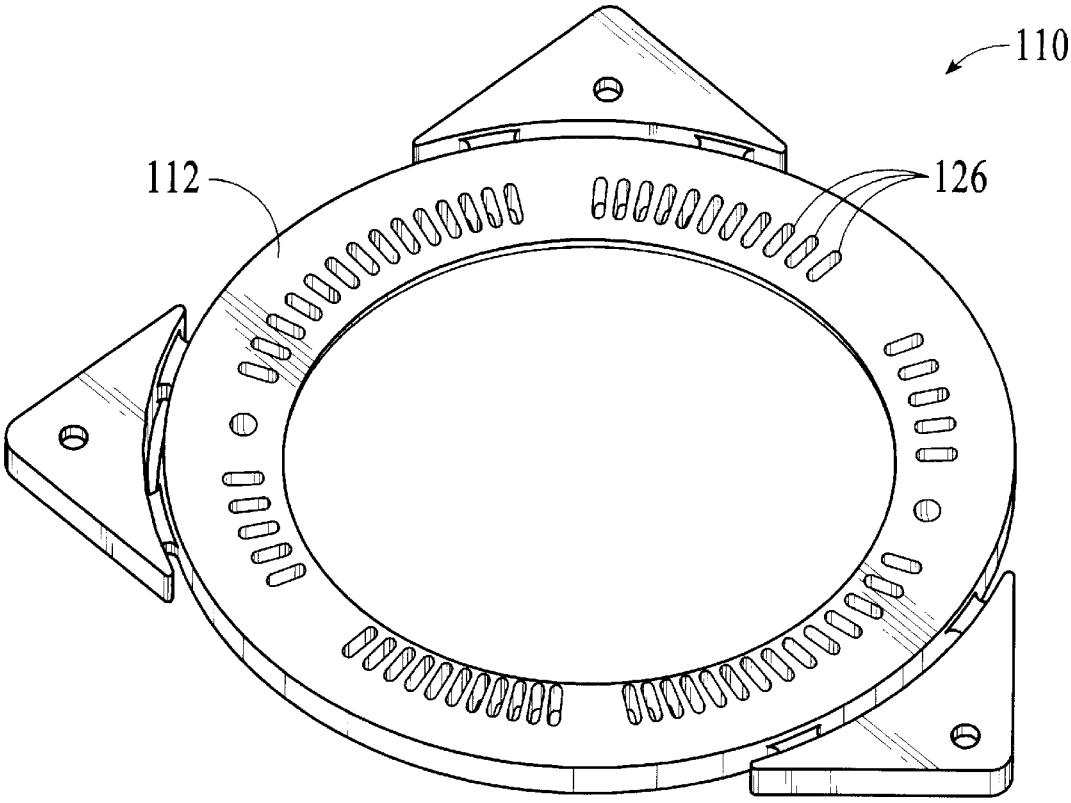
FIG. 5 is a bottom side perspective view of a second embodiment of the spacer and shim assembly.

The inventors have discovered during development of the product of the present invention that the spacer and shim assembly 10 readily accepts mounting screws driven through the soil pipe closet ring mounting flange by a power screwdriver. However, some users may desire preformed holes to receive the screws that secure the soil pipe mounting flange to the rough floor. To this end, a first alternate spacer and shim assembly 110 is illustrated in FIGS. 4 and 5. The spacer and shim assembly 110 includes a plurality of radial slots 126. The radial slots 126 allow the installer to align the provided mounting holes in the soil pipe closet ring mounting flange with a corresponding slot 126 in the spacer and shim assembly 110. The screw that secures the mounting flange to the rough floor therefore need not be driven through the annular main body 112 of the spacer and shim assembly 110. Choosing a plurality of radial slots 126 allows a means for adapting for differing diameter locations of the flange mounting screw holes, as well as compensating for the mounting screw holes of the mounting flange being situated at varying locations around the periphery of the mounting flange.

SECOND ALTERNATE EMBODIMENT

Figure 6:
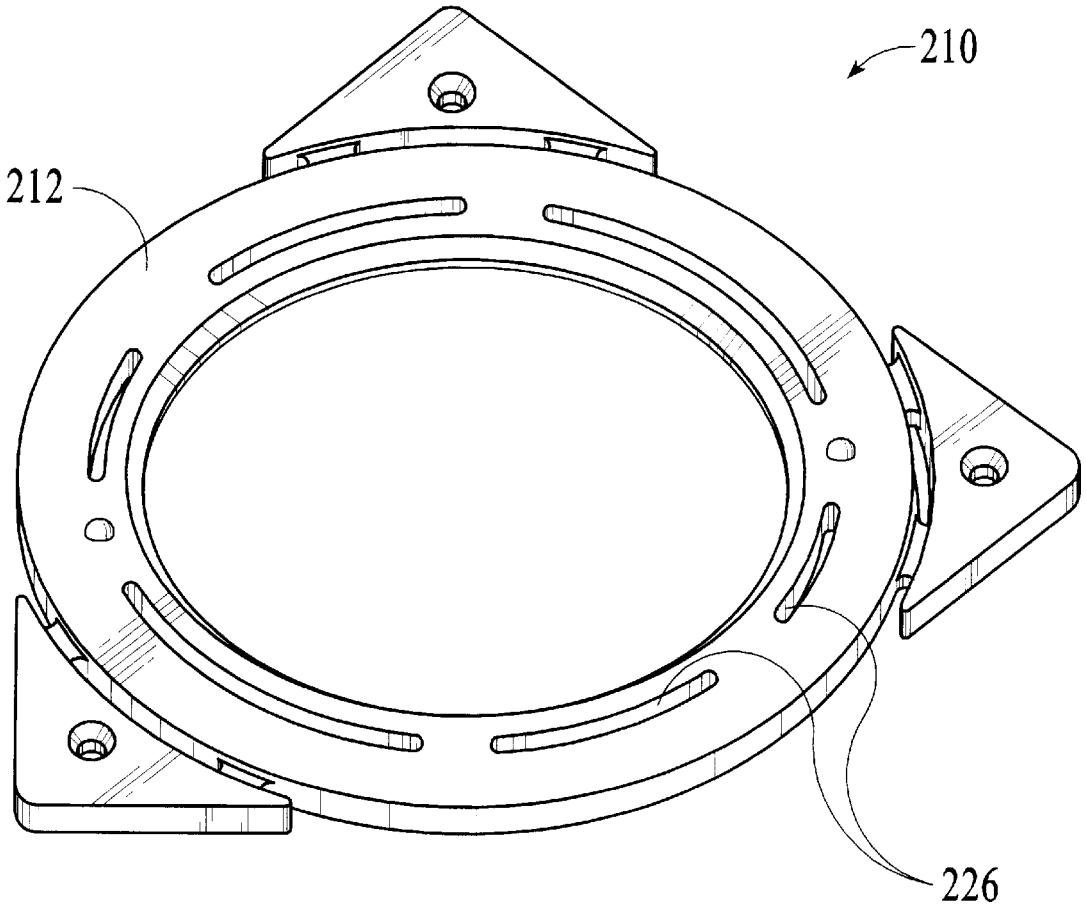
FIG. 6 is a top side perspective view of a third embodiment of the spacer and shim assembly.
Figure 7:
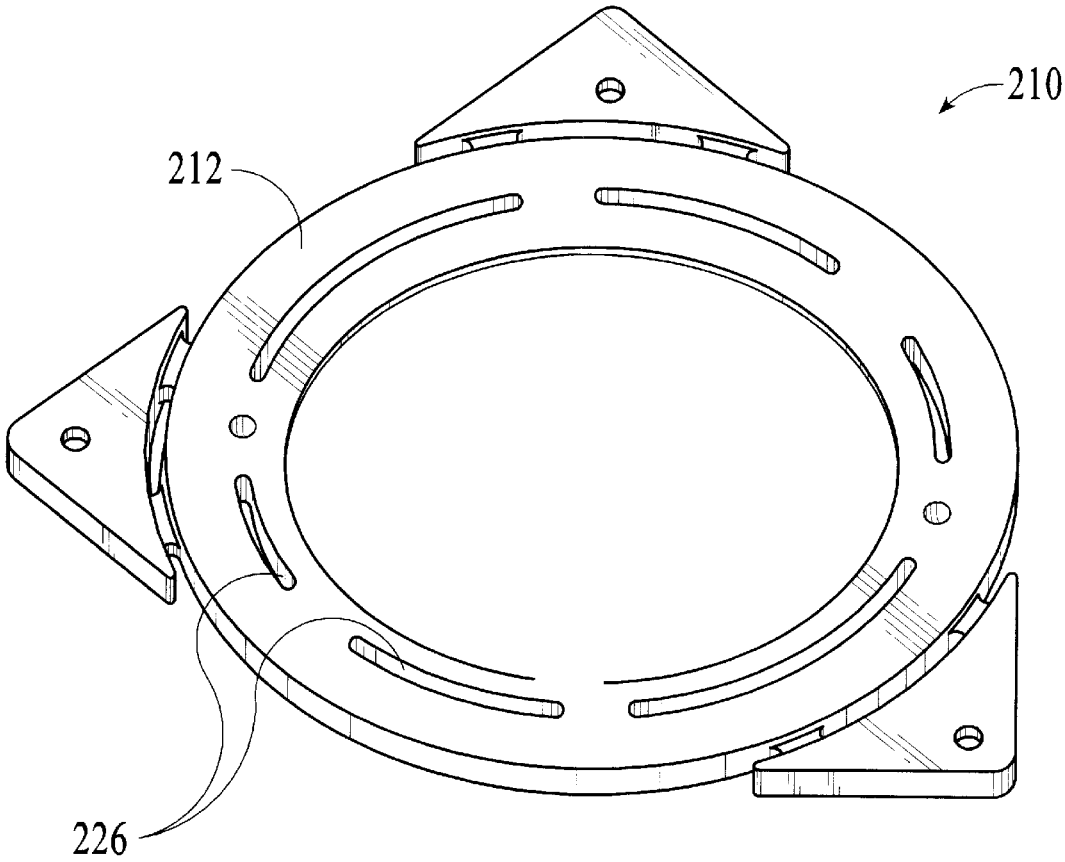
FIG. 7 is a bottom side perspective view of a third embodiment of the spacer and shim assembly.

A second alternate spacer and shim assembly 210 is illustrated in FIGS. 6 and 7. The spacer and shim assembly 210 includes a plurality of circumferential slots 226. The circumferential slots 226 provide the user with a means of adapting to compensate for the mounting screw holes of the mounting flange being situated at varying locations around the periphery of the mounting flange.

Use of all of the preferred embodiments of the present invention is as follows: The installer ascertains the intended and pre-determined finished floor height of a new or renovated building construction. The finished floor of the building need not at that time to have been completed, because the height of the finished floor material (e.g. tile or brick) is known, and the specifications are called out, in the pre-approved construction drawings.

The installation process then requires summing all unfinished floor material thicknesses from the construction plans minus the sub-floor material and the closet ring flange mount outer ring thickness to determine the required height of the spacer and shim assembly stack to yield the desired bonded height of the upper surface of the * mounting flange. The spacer and shim assemblies are joined in an appropriate size stack (generally ½" or more in multiples of ¼"), and the closet ring is ready to be installed.

A suitable solvent cement such as ABS glue is then applied to the closet ring connector hub and the drain waste pipe conduit end. The closet ring is inserted through the tapered aperture 20 of the spacer and shim assembly stack

101, so that the closet ring is welded to the drain waste pipe conduit end in the preferred manner.

Figure 8:
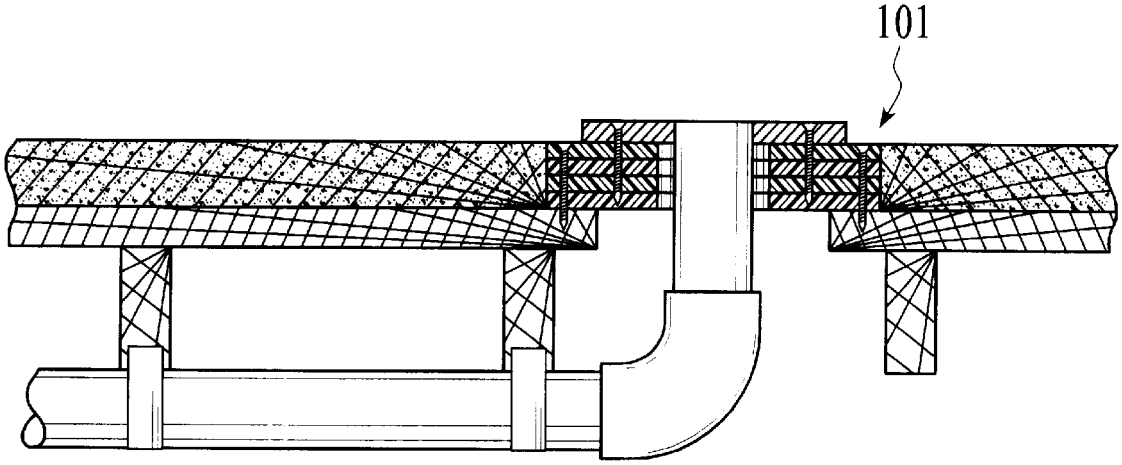
FIG. 8 is a sectional view of an installed spacer stack.
Figure 9:
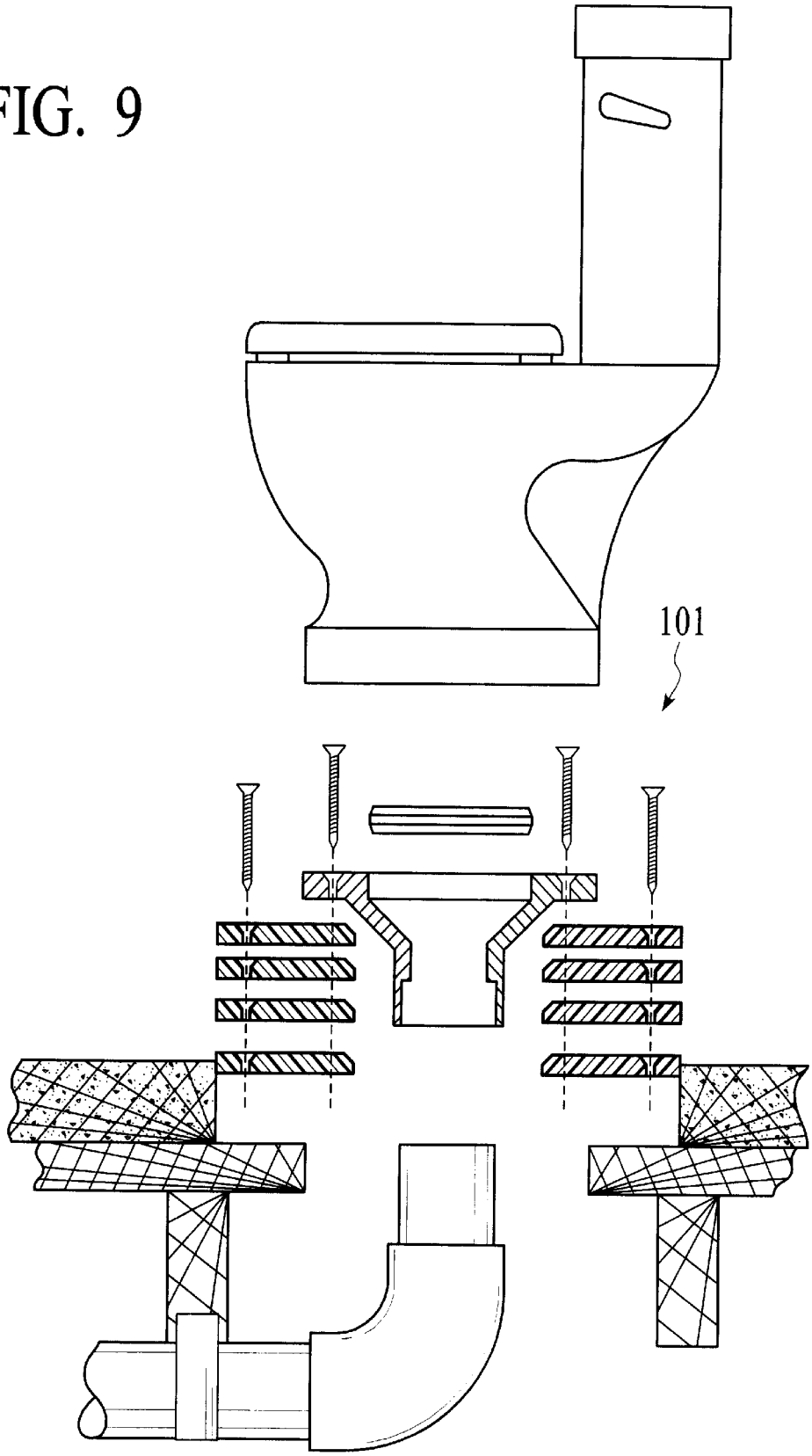
FIG. 9 is a sectional view of a toilet installation with an installed spacer stack.

The closet ring is then secured per applicable local construction code by inserting screws through the closet ring flange, through the annular main body 12 of the spacer and shim assembly 10, and on into the sub-floor, as is illustrated in FIG. 8. A complete toilet installation using the spacer and shim assembly stack 101 of the present invention is illustrated in FIG. 9.

Using special hole cutter kits, the plumber tradesmen can cut all the necessary holes for the soil pipe and closet ring installation, and complete the plumbing pipe and fitting rough-in without the participation of an independent tradesman, i.e. a carpenter. The carpenter can then later complete the installation of the floor, and the toilet bowl can then be installed compliant with the UPC.

The above disclosure is not intended as limiting. Those skilled in the art will readily observe that numerous modifications and alterations of the device may be made while retaining the teachings of the invention. Accordingly, the above disclosure should be construed as limited only by the restrictions of the appended claims.

We claim:

1. A spacer and shim assembly comprising:

an annular main body with a central aperture adapted to receive a water closet ring mounting flange; wherein at least two bosses protrude from an upper surface of said annular main body, and at least two detents are located in a lower surface of said annular main body corresponding in location to said at least two bosses in said upper surface; so that when multiple units of said spacer and shim assembly are stacked together, said bosses of a lower unit are received in said detents of an upper unit so that said lower unit is mated with said upper unit, thereby eliminating sliding and rotating of said upper unit and said lower unit relative to each other.

2. The spacer and shim assembly as defined in claim 1 wherein:

at least one mounting tab is positioned on a circumference of said annular main body, said mounting tab being separated from said annular main body by a grooved area so that said mounting tab is easily removed from said main body of said spacer and shim assembly.

3. The spacer and shim assembly as defined in claim 2 wherein:

said grooved area includes at least one area machined completely through a width of said annular main body so that at least one discrete attaching segment is formed, said attaching segment joining said mounting tab to said annular main body.

4. The spacer and shim assembly as defined in claim 1 wherein:

said spacer and shim assembly is formed from an acrylonitrile butadiene styrene plastic material.

5. The spacer and shim assembly as defined in claim 1 wherein:

said central aperture has a bevelled edge.

6. The spacer and shim assembly as defined in claim 1 wherein:

said annular main body comprises a plurality of radial slots to serve as adapting means.

7. The spacer and shim assembly as defined in claim 1 wherein:

said annular main body comprises a plurality of circumferential slots to serve as adapting means.

* * * * *